United States Patent [19]

Kuhn

[11] 4,070,838

[45] Jan. 31, 1978

[54] CLIP FOR ASSEMBLING SCREENS, PANELS OR BULKHEAD SECTIONS

[75] Inventor: Johannes Kuhn, Verden, Germany

[73] Assignee: V.G.S. G.m.b.H., Germany

[21] Appl. No.: 624,918

[22] Filed: Oct. 22, 1975

[30] Foreign Application Priority Data

| | | |
|---|---|---|
| Oct. 23, 1974 | France | 74 40152 |
| Oct. 23, 1974 | France | 74 40153 |
| Nov. 15, 1974 | France | 74 40661 |

[51] Int. Cl.[2] ..... E04B 2/72

[52] U.S. Cl. ..... 52/400; 49/DIG. 1; 52/403

[58] Field of Search ..... 52/393, 398, 400, 403, 52/397; 49/DIG. 1

[56] References Cited

U.S. PATENT DOCUMENTS 3,527,011 9/1970 Bloom et al. ..... 49/DIG. 1

FOREIGN PATENT DOCUMENTS 2,253,893 7/1975 France ..... 52/398

*Primary Examiner*—J. Karl Bell

*Attorney, Agent, or Firm*—Robert E. Burns; Emmanuel J. Lobato; Bruce L. Adams

[57] ABSTRACT

A clip for assembling panels which comprises a body having an elongated cross section which is symmetrical about a longitudinal axis of symmetry and a lateral axis of symmetry. The body has a pair of axial slots at opposite ends of the cross section which extend inwardly of the body along the longitudinal axis of symmetry. Two pair of grooves are each disposed symmetrically about a respective one of the axial slots and extend into the body generally along a longitudinal dimension of the body cross section, and the grooves open adjacent the respective one of the axial slots on opposite sides thereof. Each of the grooves have facing inner sidewalls which include portions protruding inwardly for retaining a portion of a clip support inserted therein. The clip body also has a pair of opposed lateral channels disposed symmetrically on opposite sides of the longitudinal axis of symmetry and having a width extending longitudinally of the body cross section symmetrically about the lateral axis of symmetry. Each of the lateral channels have a pair of walls having facing surfaces which protrude inwardly for retaining a clip support inserted therein. In use, clip supports are fixed to panels, and the clips engage and retain the clip supports to fasten the panels together.

12 Claims, 10 Drawing Figures

Fig.7
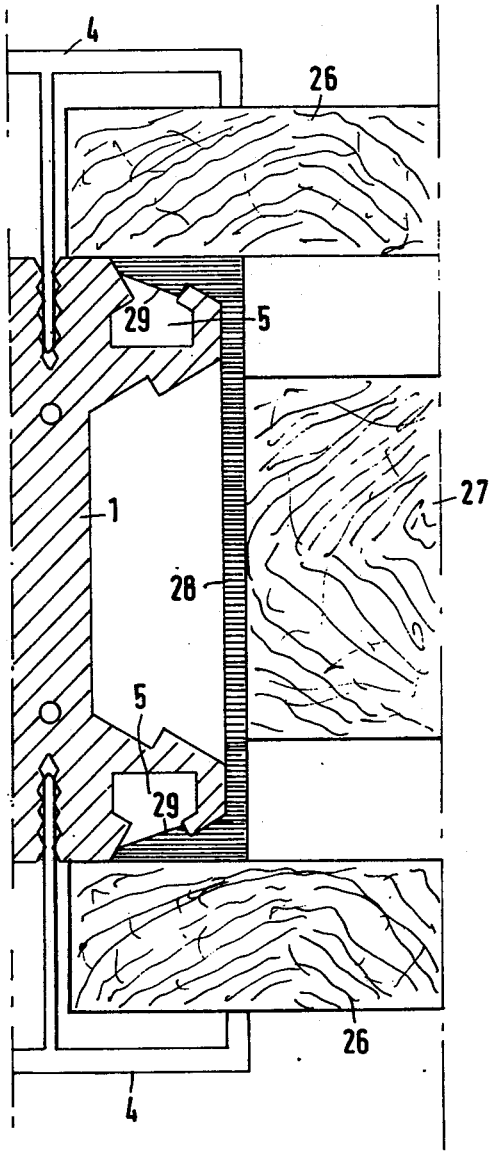
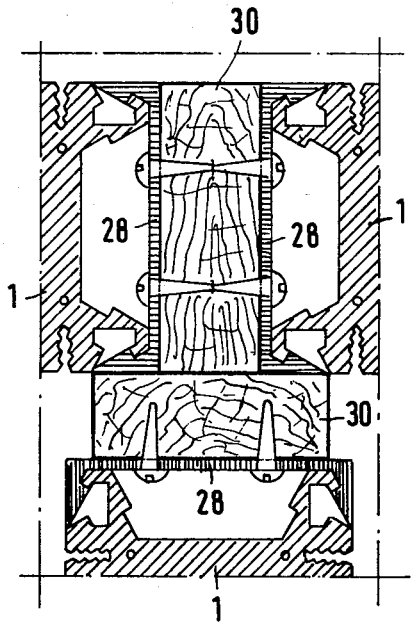
Fig.8
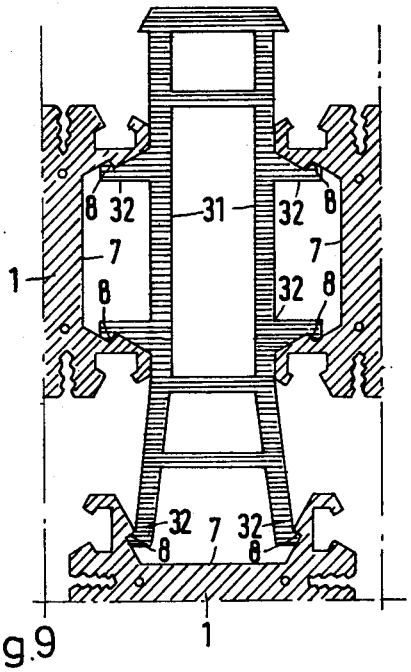
Fig.9

CLIP FOR ASSEMBLING SCREENS, PANELS OR BULKHEAD SECTIONS

BACKGROUND OF THE INVENTION

The invention concerns a clip for the assembling of screening sections or panels.

If keys or plastic connecting clips used for assembling screens made of opaque or glazed sections, and of metal sections fixed to the opaque units or forming grooves for said glazed sections, are used with or without cleats, different kinds of metal fastening, etc., the design of the keys or clips currently known limits their uses and it has always been necessary up to now to make provision for the use of several types or to leave uprights showing which, from the aesthetic viewpoint is not pleasing, particularly with glazed sections or with T-shaped or L-shaped combinations of sections.

SUMMARY OF THE INVENTION

There is an obvious benefit in using the same type of clips or keys in all instances in that only one type would need to be stocked and this can be realized by the present invention. Furthermore, the new clip according to the invention makes it possible to obtain acoustical and other insulation by the addition of seals, and a self-supporting central panel, thus avoiding the contact of metal on metal and providing the complete blanking out of heat and noise.

In accordance with the invention, a clip for assembling opaque or possibly glazed screens and metal sections fixed to opaque sections or forming grooves for said glazed sections, the clip comprises a body having an elongated cross section and having at each end an axial slot capable of receiving and supporting the internal rib of a batten or a glazing head. On both sides of its two axial slots and arranged symmetrically, the clip has a groove capable of receiving the corresponding end of a stop or seal, and which, in an arrangement of opposed pairs, are capable of receiving and holding or of inserting themselves into and holding themselves in or on the two ends of the butts or on the two corresponding inside brackets of a clip support, section, frame support of a glazed unit, door frame, angle and/or connecting or fixing corner. Moreover, the clip is preferably provided on each of its sides, with a lateral channel to receive and to hold the butts, inside brackets of a clip support, section, frame support of a glazed unit, door frame, angled and/or connecting or fixing corner.

The object of the invention is to provide a new clip, however it also embraces the different types of screen combinations which are possible from a consideration of one or all the characteristics which it embodies.

BRIEF DESCRIPTION OF THE DRAWINGS

In order to facilitate a better understanding of the invention and to bring out its benefits and characteristics, it will now be described in a manner which is intended to be exemplary and not restrictive. The description relates to the attached drawings which show:

FIG. 7. a partial and enlarged plan view of the clip shown in FIG. 1 and holding a clip support or intermediate part fixed to a self-supporting central panel.

FIG. 8. a partial plan view of clips which are identical to the clip shown in FIG. 1 and fixed to an angle connection in accordance with one configuration FIG. 9. a partial plan view of clips which are identical to the clip shown in FIG. 1 and fixed to an angle connection in accordance with a second configuration FIG. 10 a general view of a set of screens or the fire-proof type.

DESCRIPTION OF THE PREFERRED EMBODIMENTS

Figure 1:
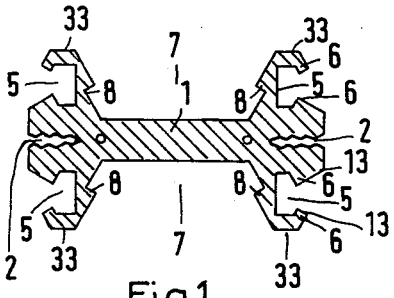
FIG. 1 a plan view of the new clip

With regard to the various drawings, FIG. 1 illustrates the clip according to the invention which at each of its longitudinal ends has an axial slot 2 which holds the rib 3 of a batten or a glazing bead, 4,4'. On opposite sides of said slot are a pair of grooves 5 provided with two notches 6 which could be replaced, for example, by serrations or ridges. The clip 1 is moreover also preferably equipped with two lateral slots 7 which are themselves provided with two notches 8 which could be replaced by serrations or ridges. Thus, different methods are provided for attaching various section and/or other parts to the clip 1 which is made preferably of a plastic material such as polyamide, as are a few accessories, in order to achieve acoustical and thermal insulation. There now follows a description of some of these possibilities.

Figure 2:
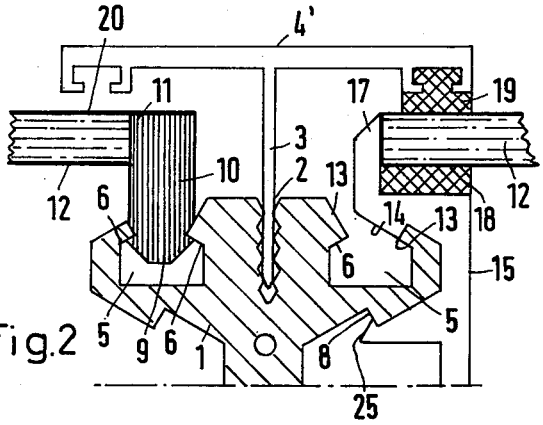
FIG. 2 a partial and enlarged plan view of the clip shown in FIG. 1 and gripping the base of a stop.
Figure 3:
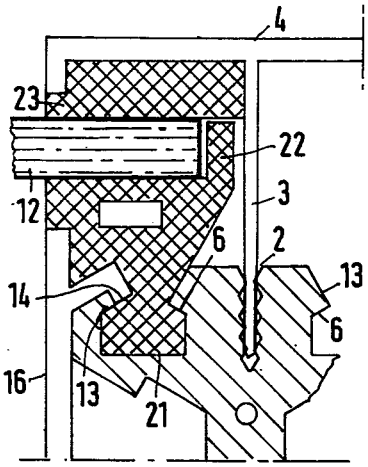
FIG. 3 a partial and enlarged plan view of the clip shown in FIG. 1 and gripping the base of an air seal.
Figure 5:
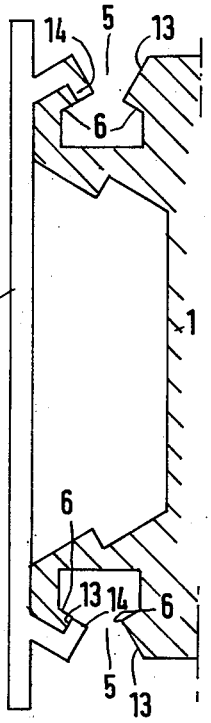

A groove 5 (FIG. 2) can, because of the retaining notches 6, be used to hold and retain the end 9 of a stop 10, the lateral face 11 of which makes it possible to wedge an opaque or glazed screening unit 12. The enlarged entrance 13 of the groove 5 is also used, for example (FIGS. 2, 3 and 5), to receive the butt 14 of a U-shaped 15 (FIG. 1), 16 (FIGS. 3 and 5) capping the entire width of the clip 1 (FIG. 5). A bracket 17 on section 15 (FIG. 1) makes it possible to wedge a section of screening 12 which can be fitted with a seal 18 and a seal 19 held by a groove 20 provided at the glazing bead.

In another arrangement (FIG. 3), although the enlarged part of the groove 5 is partially filled by the butt 14 of a section 16, it is still possible to make provision for the groove to receive the end 21 of a seal 22 which acts as a support for supporting opaque or glazed screening 12. The assembly can be perfected by the provision of another joint 23 made of an absorbant material and held or stuck to the glazing bead 4.

Figure 4:
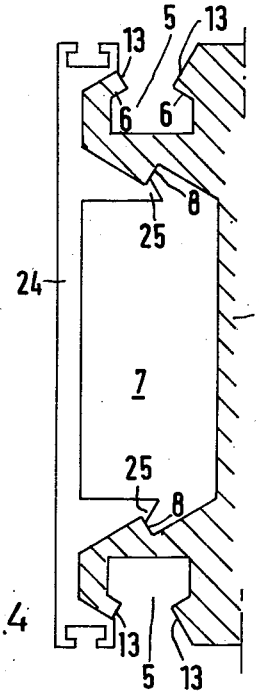
FIG. 4 a partial and enlarged plan view of the clip shown in FIG. 1 and gripping a metal riser section in accordance with one configuration FIG. 5. a partial and enlarged plan view of the clip shown in FIG. 1 and gripping a metal riser section in accordance with a second configuration FIG. 6. a partial and enlarged plan view of the clip shown in FIG. 1 holding a clip support or intermediate part fixed to a cleat.

It will be noticed, in referring to the left-hand side of FIG. 1, that the entire groove 5 is utilised and is unable to receive the butt 14 of a section 15 or 16. Nevertheless, the clip is still effective since in this present case it is not possible to utilise the lateral groove 7 and the retaining notches 8 with which it is provided. In this manner it is possible to engage the clip 1 (FIG. 4) on a section 24, the butts 25 engaging on the retaining notches 8 or, if possible, to make provision for the clip 1 to engage the U-shape section 15 at two points (FIG. 2, right-hand side), viz. by its butt 14 on the enlarged part of the clip 1 and by its butt 25.

The grooves 5 as well as the slots 7 in the clip 1 can be used for purposes other than that of engaging on, or being engaged by sections 15, 16, 25 and seals 22 or stopps 10 which are the various parts necessary to improve the acoustical or thermal insulation with or without seals 19 and 23, assuring a perfect fit for glazed as well as opaque screening units 12 without the necessity of providing large dimensioned glazing beads or, in the case of glazed screening, of leaving connecting parts visible. Such beneficial characteristics will be seen in the following assemblies.

To this end, panel sections 26 (FIG. 7) can receive between them a third panel 27 which is fixed on its side by U-shaped pieces 28 which receive the clips 1, U-shape pieces 28 with butts 29 engaging in the grooves 5 of clips 1. Like the clips, these pieces are made of a plastic material such as polyamide. Thus it is possible to make a screen which is completely self-supporting or even to provide, in place of a third panel 27, an upright (not shown) which is fastened to the floor or held between the floor and the ceiling by a jack fixture and then to fix the U-shaped pieces 28 to said upright.

Figure 6:
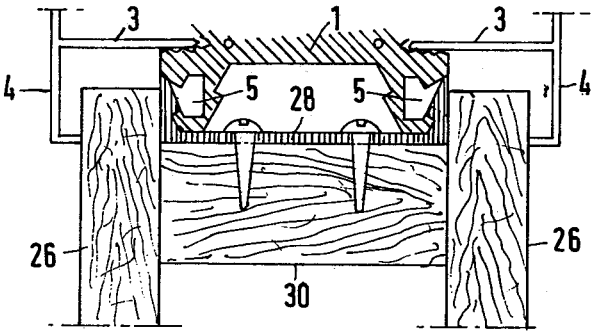

In another version (see FIG. 6) the pieces 28 are fixed on cleats 30 which keep the panels 26 apart. Clip 1 can also be used for an angled assembly of screening elements, either T-shaped or L-shaped or even X-shaped (FIGS. 8 and 9) which can be achieved by an assembly of two cleats 30 on which are fixed pieces 28 for receiving the clips 1 in the same manner as described above with reference to FIGS. 6 and 7 or by providing a special support 31 (FIG. 9) having ribs 32 which engage with the retaining notches 8 of slots 7 on clips 1. The support 31 could be made by moulding.

For an L-shaped assembly, only one of the two parallel clips holding the screen sections is used, three for a T-shaped assembly. For an X-shaped assembly additional ribs 32 are provided on support 31 or a third cleat 30 is provided in parallel with another, and fourth clip is mounted thereon.

Moreover, there are special battens (not illustrated) which close the faces where no screen section is connected and larger glazing beads can be provided to fit into the clips positioned in parallel.

The clip thus described is therefore particularly useful since it meets all the requirements of assembling opaque or glazed screen sections in parallel in such configurations as T, L or X by including for example the supports of door frames and posts. In effect, the sections 15, 16 and 24 can be supports or posts or parts of the same, the fastening of the clip 1 being either direct or by means of a part 28 or even a second intermediate piece situated between part 28 and the support or post, whilst at the same time preserving the advantages mentioned above.

The shape of the clip 1 illustrated in the attached drawing could be different, the groove 7 being proportionally wider so as to increase the support faces 33 (FIG. 1) of the clip 1, parallel to its centre line, for the purpose of increasing the strength of the clip and of the assemblies made.

It must also be noted that the middle slots 7 of the clip 1 can facilitate the positioning of a pane of screening, whether it be a single, triple or even double pane unit; or they may serve, for example, to support a glazing bead.

It can therefore be seen that the number of possible different configurations which can be realized by the new clip are considerable, providing for example for screens which, though they can always be taken down, nevertheless go to make up a wall which remains fire-proof for a relatively long period of time (FIG. 10), whereas previously, in order to achieve the same effect, it was necessary to use such materials as asbestos cement both for the screen and for covering the batten and the main edge faces of the screen sections. Such a process was complex, expensive and gave rise to a significant protrusion. Or alternatively the fire-proof screens could not be taken down, their component parts being fixed to posts which were generally of metal and fastened to the floor.

Figure 10:
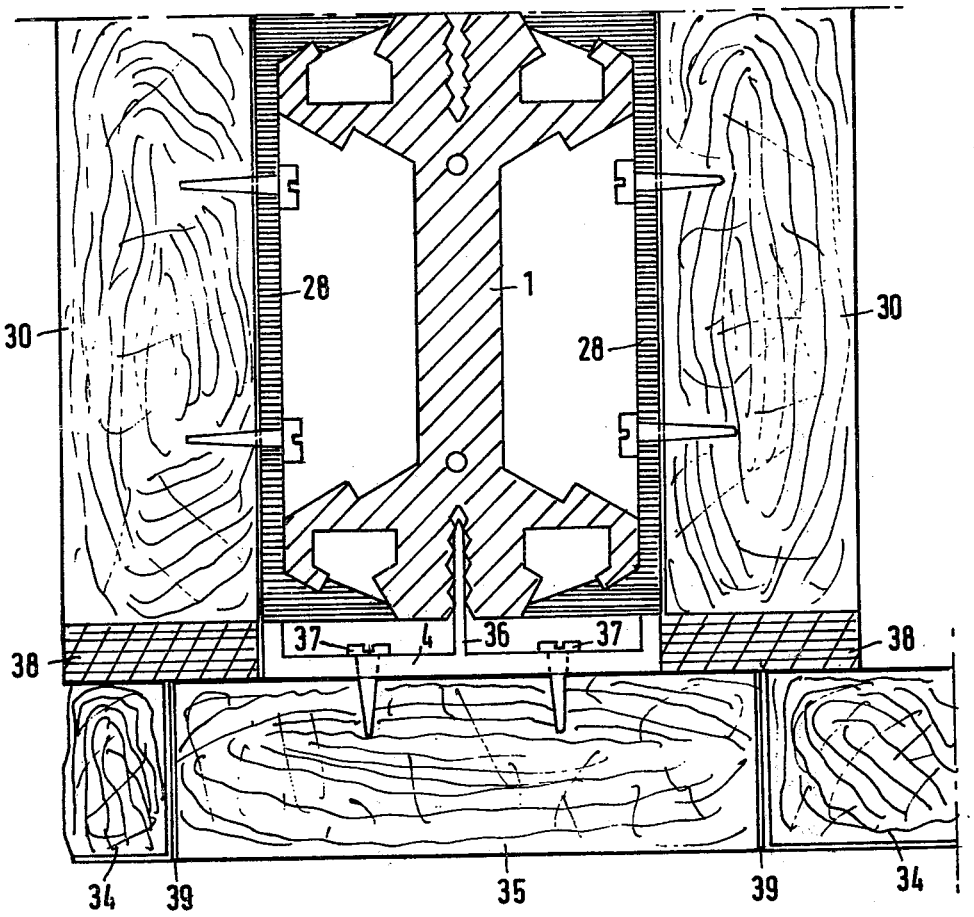

FIG. 10 shows a solution to such a problem by the use of the clip 1 which is provided laterally with parts 28 which are fixed for example by means of screws to cleats 30 intersecting screen sections 34 made of flame-proof material. Said sections 34 are preferably off-set towards the rear in relation to the cleats 30. In the gap between two consecutive sections 34, a strip 35 is placed which is also made of fire-proof material and which has on the inside a rib 36 which in the example illustrated a standard batten 4 which is for example fixed by means of screws 37 to said strip 35 which fills the entire space between the screen sections 34. In this case it is sufficient to provide batten sections 4 at those points where clips 1 are situated.

In order to perfect the system, provision is made for the cleats 30 to be supplied laterally with an insulating strip 38 in order to remove any danger of a possible gap occurring between the strip 35 and the sections 34 of the screen. Another possible solution, which is not illustrated, consists in providing a cut-out along the edge of two consecutive sections 34 so as to obtain a tongue similar to the insulating strip 38. It is interesting to observe that the thickness of the strip 35 can be varied in such a way that, from the outside, the strip 35 and the consecutive sections of screening 34 are flush. Since the strip 35 could be made of the same material as the sections 34, it would be barely visible.

Apart, therefore, from the fact that the same clip 1 can be used in all instances in the assembling of screening sections, it also has many advantages in that it reduces the number of sections used. In effect, it is possible to fix the clip directly on to a support post and conversely, to fix the post supports straight on to the clip, whereas previously the clips were fixed on to self-supportinng posts to which were fixed the sections which were themselves fixed finally to the supports. This required a considerable amount of labour as well as the manufacturing of sections which have become superfluous. In addition, there was the necessity of providing very wide battens.

From the acoustical point of view, besides the possibilities of being able to make provision to fix seals in the manner indicated, a particularly beneficial solution to the problem is afforded by the use of a central self-supporting screen which acts as a section to carry the clips 1.

I claim:

1. A clip comprising: a body having an elongated cross section symmetrical about a longitudinal axis of symmetry and a lateral axis of symmetry; said body having a pair of axial slots at opposite ends of the cross section and extending inwardly of the body along the longitudinal axis of symmetry; said body having two pairs of grooves each disposed symmetrically about a respective one of the axial slots and extending into the body generally along a longitudinal dimension of the body cross section and opening adjacent the respective one of the axial slots on opposite sides thereof, each of said grooves having facing inner side walls defining means for retaining; and said body having a pair of opposed lateral channels disposed symmetrically on opposite sides of the longitudinal axis of symmetry and having a width extending longitudinally of said body cross section symmetrically about the lateral axis of symmetry, each of the lateral channels having a pair of walls having facing surfaces defining means for retaining.

2. A clip according to claim 1, wherein: each of said grooves includes a pair of opposed facing side walls generally extending along the longitudinal dimension of said cross section, said pair of opposed facing side walls having a distance therebetween defining a width dimension of the groove, the pair of opposed facing side walls having portions converging toward each other to define a narrow width portion of the groove and the converging portions of the opposed facing side walls defining means for retaining.

3. A clip according to claim 1, wherein: each of said lateral channels includes a pair of opposed facing side walls generally extending along the transverse dimension of said cross section; said pair of opposed facing side walls having a distance therebetween defining a width dimension of the channel, the pair of opposed facing side walls having portions converging toward each other to define a narrow width portion of the channel and the converging portions of the opposed facing side walls defining means for retaining

4. A clip according to claim 1, wherein the axial slots are defined by opposed corrugated surfaces.

5. A clip according to claim 1, wherein ends of the clip have at least two side surfaces angled, one towards the longitudinal axis of the clip, the other in the opposite direction.

6. A clip according to claim 1, having at least two supporting faces which are parallel to the longitudinal axis of the clip and which are situated on either side of the lateral channels.

7. A clip according to claim 1, in combination with a clip support having a U-shaped section and provided on an inside face whose shape is complementary to that of the grooves of the clip for engaging therewith and being retained thereby.

8. A clip and clip support in accordance with claim 7, wherein the clip support is made of a plastic material.

9. In combination, a panel; a clip support fixed to said panel; and a clip for engaging said clip support; wherein said clip comprises a body having an elongated cross section symmetrical about a longitudinal axis of symmetry and a lateral axis of symmetry; said body having a pair of axial slots at opposite ends of the cross section and extending inwardly of the body along the longitudinal axis of symmetry, said body having two pair of grooves each disposed symmetrically about a respective one of the axial slots and extending into the body generally along a longitudinal dimension of the body cross section and opening adjacent the respective one of the axial slots on opposite sides thereof, each of said grooves having facing inner side walls defining means for retaining, and said body having a pair of opposed lateral channels disposed symmetrically on opposite sides of the longitudinal axis of symmetry and having a width extending longitudinally of said body cross section symmetrically about the lateral axis of symmetry, each of the lateral channels having a pair of walls having facing surfaces defining means for retaining; and wherein said clip support comprises a body having a U-shaped section having an inner face complementary to the grooves of the clip for engaging therewith and being retained thereby.

10. A combination in accordance with claim 9, wherein the panel includes an inner support for strengthening the panel, and the clip support is fixed to the inner member.

11. A device for assembling screens or bulkheads in accordance with claim 10 characterized in that the inner member is an intermediate panel which may, or may not, be self-supporting.

12. A combination in accordance with claim 9 further comprising cleats assembled in a 'T' configuration a clip support fixed on each of the cleats, and clips which are supported by respective ones of the clip supports so as to form an angled assembly comprising at least two clips positioned at an angle to one another.

* * * * *